US006009634A

United States Patent [19]

Retulainen

[11] Patent Number: 6,009,634

[45] Date of Patent: Jan. 4, 2000

[54] APPARATUS FOR DRYING FIBER WEB

[75] Inventor: Elias Retulainen, Kulju, Finland

[73] Assignee: Valmet Corporation, Helsinki, Finland

[21] Appl. No.: 08/953,206

[22] Filed: Oct. 17, 1997

[30] Foreign Application Priority Data

Oct. 30, 1996 [FI] Finland ..... 964378

[51] Int. Cl.[7] ..... F26B 13/26

[52] U.S. Cl. ..... 34/71; 34/95; 34/116

[58] Field of Search ..... 34/355, 421, 422, 34/71, 95, 110, 116, 117, 120, 123, 613, 619, 620, 624, 636; 162/206, 207, 375, 358.3, 358.5

[56] References Cited

U.S. PATENT DOCUMENTS

| | | | |
|---|---|---|---|
| 4,461,095 | 7/1984 | Lehtinen | 34/392 |
| 5,071,513 | 12/1991 | Bluhm et al. | 162/206 |
| 5,594,997 | 1/1997 | Lehtinen | 34/95 |
| 5,778,555 | 7/1998 | Lehtinen et al. | 34/71 |
| 5,867,919 | 2/1999 | Retulainen | 34/71 |

FOREIGN PATENT DOCUMENTS 9611300 4/1996 Finland .

*Primary Examiner*—H. A. Bennett
*Assistant Examiner*—Pamela A. Wilson

[57] ABSTRACT

An apparatus for drying a fiber web, in which apparatus the fiber web (5) is dried between two tight bands (1, 2) moving in the same direction and turning around turning rolls (6*a*, 6*b*, 7*a*, 7*b*). The first band (1) is heated by means of a pressure chamber (9) and the second band (2) is cooled by means of a water chamber (10). The fiber web (5) is led together with at least one felt or wire (3, 4) through a drying zone defined by the bands (1, 2) in such a way that the fiber web is in contact with the surface of the first band (1) and the felt or wire (3, 4) is between the fiber web (5) and the second band (2). At least one band (1, 2) is guided by a shoe (11*a*, 11*b*) in such a way that the fiber web substantially immediately upon coming into contact with the first band (1) is exposed to the effect of the compression pressure of the pressure chamber (9). Then the drying of the fiber web (5) surface has no time to reduce the plasticity of the web surface and it is also possible to prevent the fiber web from pealing.

6 Claims, 2 Drawing Sheets

APPARATUS FOR DRYING FIBER WEB

Figure 1:
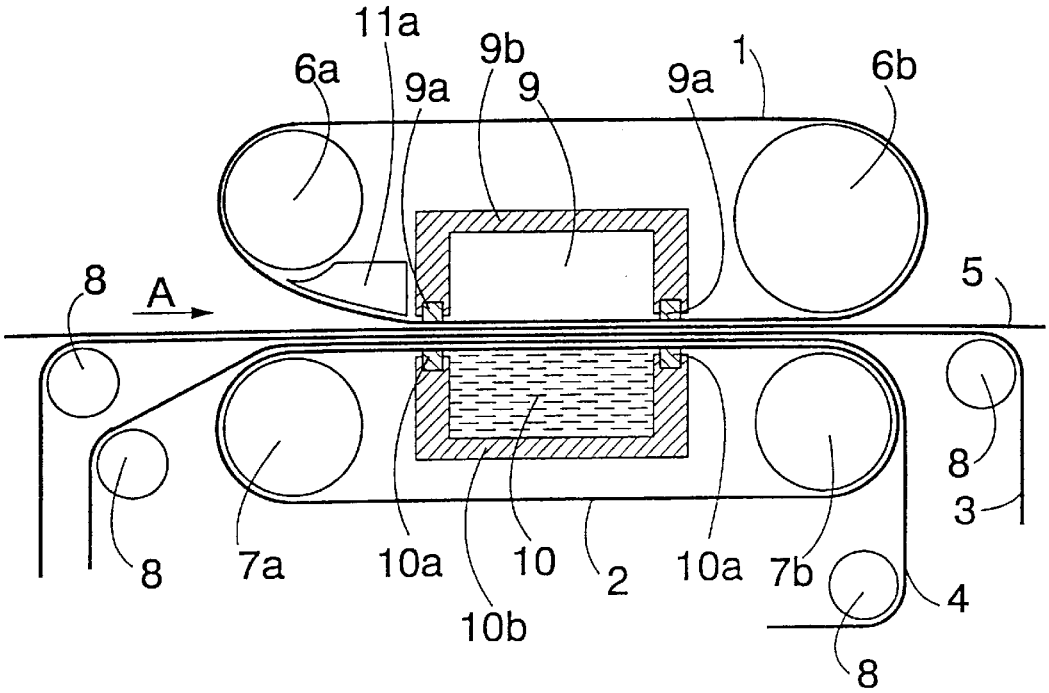

The invention relates to an apparatus for drying a fiber web, the apparatus comprising two endless air impermeable bands, first turning rolls, the first band being arranged to turn around the first turning rolls, and second turning rolls, the second band being arranged to turn around the second turning rolls, whereby the first band and the second band are arranged to run part of the way parallel with each other in such a way that they form a drying zone between them, the first band being arranged to be heated by heating means and the second band being arranged to be cooled by a chamber containing pressurized medium, whereby the fiber web and at least one felt or wire are led between the bands in such a way that the fiber web is in contact with the heated first band, and the felt or the wire is between the fiber web and the cooled second band, respectively, and whereby a chamber containing pressurized medium is arranged against the first band to press the fiber web.

Drying a fiber web between two parallel metal bands moving in the same direction in such a way that the fiber web is in contact with the heated metal band and there is a wire between the fiber web and the second cooled metal band so that the steam separated from the fiber web due to heating condenses to the wire by the effect of the cold metal band, is known from several patent publications, from which can be mentioned e.g. International Patent Application WO 96/11300 and U.S. Pat. No. 4,461,095. The operation is based on that two endless metal bands are arranged to run around turning rolls and that pressure chambers containing hot steam and water, respectively, are provided against the inner surface defined by the loops formed by the bands so that the pressure produced presses the hot and the cold band, and respectively, the fiber web and the wire between them towards each other. The bands located between the pressure chambers provide by means of seals one side for the pressure chambers so that the steam and water can directly affect the bands. The operation of the apparatus is fully known per se and disclosed e.g. in the above patent publications, which are incorporated herein by reference.

International Patent Application WO 96/11300 discloses that press means are located in the vicinity of the first turning rolls for exposing the fiber web to a higher compression than the remaining drying zone. However, also in this apparatus, the fiber web is in contact with the hot band even before it is exposed to a continuous compression caused by a pressure chamber. Then the web begins to dry immediately upon coming into contact with the hot band, which drying reduces the plasticity of the web surface even before the web is exposed to the compression of the pressure chamber. Further, before being exposed to the compression of the pressure chamber, the fiber web may peal, if the temperature inside the web is allowed to rise too much.

The object of the present invention is to provide an apparatus, by which the drawbacks described above can be avoided.

The drying apparatus according to the invention is characterized in that the apparatus comprises means for guiding at least one band between a turning roll and the pressure chamber in such a way that the fiber web is exposed to the compression pressure of the pressure chamber substantially immediately upon coming into contact with the first band.

An essential idea of the invention is that the apparatus comprises means for guiding a hot band and/or a cooler band in such a way that the fiber web comes into contact with the surface of the hot band substantially in the vicinity of a pressure chamber, whereby the fiber web is exposed to the compression pressure of the pressure chamber substantially immediately upon coming into contact with the hot band. Further, the idea of a preferred embodiment is that a shoe is used as the means guiding the band.

An advantage of the invention is that the fiber web does not substantially come into contact with the hot band until the fiber web is exposed to the compression of the pressure chamber, whereby the drying of the web surface has no time to reduce the plasticity of the web surface, and thus, the properties of the fiber web can be formed as desired. Another advantage is that the fiber web can be prevented from pealing by means of the apparatus of the invention.

The invention is described in greater detail in the attached drawings, where

Figure 2:
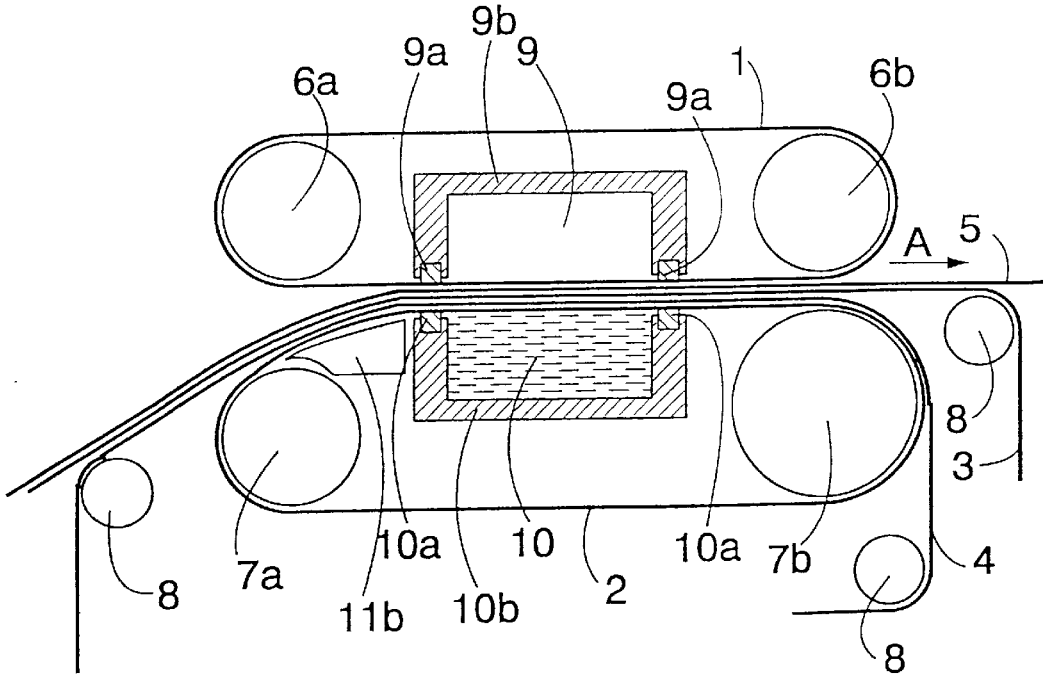
Figure 3:
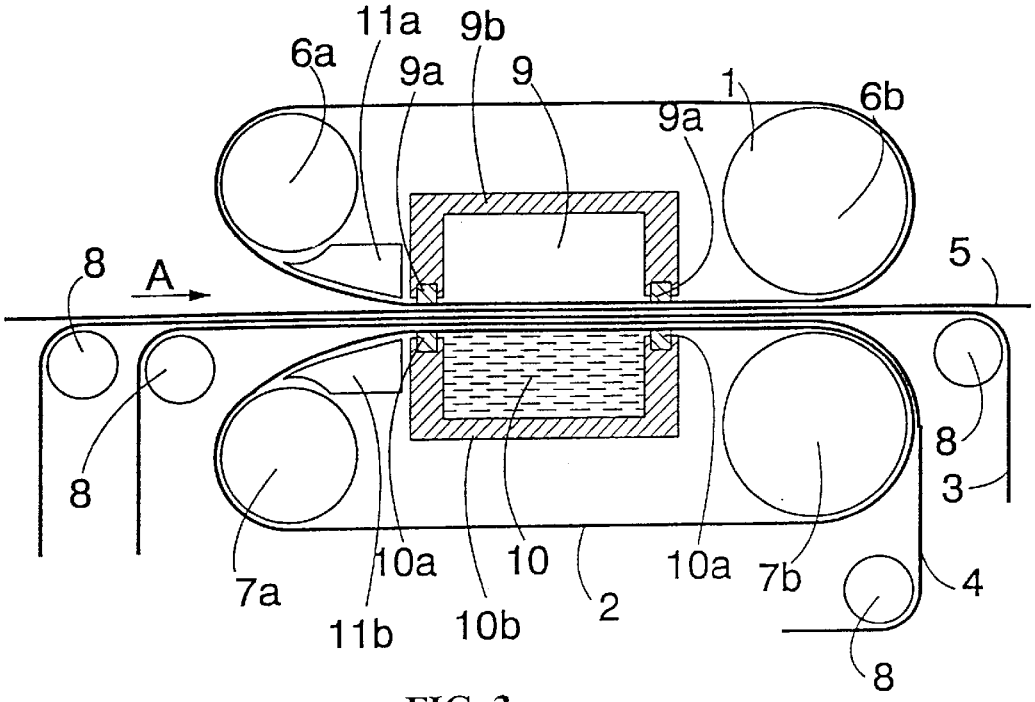

FIG. 1 is a schematic sectional side view taken in the travel direction of the web, illustrating an apparatus for drying a fiber web according to the invention, FIG. 2 is a schematic sectional side view taken in the travel direction of the web, illustrating a second apparatus for drying a fiber web according to the invention, and FIG. 3 is a schematic sectional side view taken in the travel direction of the web, illustrating a third apparatus for drying a fiber web according to the invention.

FIG. 1 is a schematic sectional side view taken in the travel direction of the web, illustrating a drying apparatus according to the invention. The drying apparatus comprises endless bands that are impermeable to air, conduct heat well and are preferably made of metal: viz. a first band 1, i.e. an upper band, and a second band 2, i.e. a lower band, a fine wire or felt 3, a coarse wire 4 and a fiber web 5 running between those surfaces of the bands that face each other. The fiber web 5 moves in the direction indicated by arrow A. The first band 1 is arranged to turn around first turning rolls 6*a* and 6*b* located at the ends of the drying apparatus. Correspondingly, the second band 2 is arranged to turn around second turning rolls 7*a* and 7*b* also located at the ends of the drying apparatus, below the first turning rolls 6*a* and 6*b*. The wires 3 and 4 are supported and guided by means of guide rolls 8. Since the pressure prevailing in the drying zone in the area between the bands 1 and 2 is usually different from the pressure prevailing outside or on the sides of the bands 1 and 2, seals are arranged on both sides of the apparatus between or at the edges of the bands 1 and 2, the seals preventing liquid or gas from moving out of the area between the bands 1 and 2 sidewards, or vice versa. To effect vapor heating required by the drying, the drying apparatus comprises a pressure chamber 9, which is located above the first band 1. The first band 1 is sealed with seals 9*a* to the body 9*b* of the pressure chamber 9 so that the steam in the pressure chamber 9 is maintained at a suitable pressure. Below the second band 2 there is a water chamber 10 containing water that cools the second band 2. At the edges of the water chamber 10 there are seals 10*a*, with which the second band 2 is sealed to the body 10*b* of the water chamber 10.

The operation of the drying apparatus is based on heating the first band 1, which is in contact with the web 5, by hot steam contained in the pressure chamber 9. The temperature of the first band causes the water in the web 5 to be vaporized and transferred through the wires 3 and 4 toward the second band 2. The second band 2, in turn, is cooled continuously with water located below it, whereby the steam produced on the surface thereof condenses into water and is removed with the band 2 and the wire 4.

In front of the pressure chamber 9 there is an upper shoe 11*a*. The upper shoe 11*a* functions as a means by which the first band 1 is guided from the turning roll 6*a* onto the fiber web 5. The upper shoe 11*a* is arranged with respect to the pressure chamber 9 in such a way that the fiber web 5, substantially immediately upon coming into contact with the first band 1, is exposed to the compression of the pressure chamber 9.

FIG. 2 is a schematic sectional side view taken in the travel direction of the web, illustrating a second drying apparatus according to the invention. Reference numerals of FIG. 2 correspond to those of FIG. 1. In front of the water chamber 10, there is a lower shoe 11*b*, by which the second band 2 is guided from the turning roll 7*a* between the water chamber 10 and the pressure chamber 9. The wires 3 and 4 are arranged in such a way that the fiber web 5 at first comes into contact with the second band 2 and, guided by the lower shoe 11*b*, does not come into contact with the first band 1 until substantially just before coming between the pressure chamber 9 and the water chamber 10.

FIG. 3 shows a schematic sectional side view taken in the travel direction of the web, illustrating a third drying apparatus according to the invention. Reference numerals of FIG. 3 correspond to those of the FIGS. 1 and 2. The upper shoe 11*a* is arranged to guide the first band 1 from the turning roll 6*a*, and respectively, the lower shoe 11*b* is arranged to guide the second band 2 from the turning roll 7*a*. By means of the wire 3, the fiber web is arranged in such a way that it comes into contact with the first band 1 and the second band 2 substantially simultaneously, substantially just before being exposed to a compression between the pressure chamber 9 and the water chamber 10.

The upper shoe 11*a* and the lower shoe 11*b* can be provided in several different ways. They can be either hydrostatic or hydrodynamic or combinations thereof or they have been provided by sliding surfaces or in some other manner fully known per se. The shoe can also be used for heating the first band 1.

The drawings and the description relating to it are only intended to illustrate the idea of the invention. As to the details, the invention may vary within the scope of the claims. So it is not essential which pressure medium is used in the pressure chamber 9 and the water chamber 10. The medium of the pressure chamber 9 can thus be steam, air, or hot combustion products of fuel, or water, for instance. In addition to water, also e.g. air can be used as medium in the water chamber 10. Before the pressure chamber 9, separate press means are also possible, but it is then essential for the apparatus according to the invention that the press means are located substantially just before the pressure chamber 9. Then the fiber web is substantially immediately upon coming into contact with the first band 1 exposed to a pressure effect. Accordingly, in this application, the definition that the fiber web 5 is exposed to the compression pressure of the pressure chamber 9 substantially immediately upon coming into contact with the first band 1, also comprises the alternative that the fiber web 5 at first is exposed to a compression caused by the separate press means and substantially immediately after this to the compression pressure of the pressure chamber 9.

In addition to the heating by the pressure chamber 9, the first band 1 can also be heated at other places in manners fully known per se. Further, the heating of the first band 1 can take place also entirely outside the pressure chamber 9, whereby the pressure chamber 9 only causes a compression pressure on the fiber web 5.

Instead of a shoe or shoes, the means for guiding the band can consist of thin reels or rolls, a blow box, a rotating chain, or the bands can be supported by sealing faces and pressure. Further, e.g. an overpressure chamber designed in some suitable manner or some other corresponding means can be used for the guiding.

I claim:

1. Apparatus for drying a fiber web, the apparatus comprising two endless air impermeable bands, first turning rolls, the first band being arranged to turn around the first turning rolls, and second turning rolls, the second band being arranged to turn around the second turning rolls, wherein the first band and the second band are arranged to run part of the way parallel with each other so that they form a drying zone between them, the first band being arranged to be heated by heating means and the second band being arranged to be cooled by a chamber containing pressurized medium, whereby the fiber web and at least one felt or wire are led between the bands in such way that the fiber web comes into contact with the heated first band and the felt or the wire is between the fiber web and the cooled second band, wherein another chamber containing pressurized medium is arranged against the first band for pressing the fiber web, and wherein means for guiding at least one of the bands from the turning rolls and the other chamber expose the fiber web to the pressing substantially immediately upon the coming into contact with the first band.

2. Apparatus according to claim 1, wherein the means for guiding the band is arranged to guide the first band.

3. Apparatus according to claim 1, wherein the means for guiding the band is arranged to guide the second band.

4. Apparatus according to claim 1, wherein both the first band and the second band are arranged to be guided by means of guiding a band.

5. Apparatus according to claim 1, wherein a shoe is used as the means for guiding the band.

6. Apparatus according to claim 1, wherein the pressure chamber is arranged to heat the first band.

* * * * *